US012680229B2

(12) United States Patent
Luneau

(10) Patent No.: US 12,680,229 B2
(45) Date of Patent: Jul. 14, 2026

(54) METHOD FOR APPLYING COATING CHEMICALS TO YANKEE DRYERS FOR TISSUE AND TOWEL PRODUCTION

(71) Applicant: ECOLAB USA INC., St. Paul, MN (US)

(72) Inventor: Dominic Luneau, Victoriaville (CA)

(73) Assignee: Ecolab USA Inc., St. Paul, MN (US)

( * ) Notice: Subject to any disclaimer, the term of this patent is extended or adjusted under 35 U.S.C. 154(b) by 469 days.

(21) Appl. No.: 18/303,462

(22) Filed: Apr. 19, 2023

(65) Prior Publication Data

US 2023/0349100 A1 Nov. 2, 2023

Related U.S. Application Data

(60) Provisional application No. 63/336,742, filed on Apr. 29, 2022.

(51) Int. Cl.
*D21F 5/18* (2006.01)
*D21F 7/00* (2006.01)

(52) U.S. Cl.
CPC ..... *D21F 5/181* (2013.01); *D21F 7/003* (2013.01)

(58) Field of Classification Search
None
See application file for complete search history.

(56) References Cited

U.S. PATENT DOCUMENTS 4,410,419 A 10/1983 Ferm
5,650,072 A 7/1997 Mc Clain et al.
5,654,799 A 8/1997 Chase et al.
5,705,721 A 1/1998 Patel
6,187,139 B1 * 2/2001 Edwards ..... D21F 11/14 162/111
6,365,004 B1 4/2002 Hamström et al.
6,416,624 B1 7/2002 Nielsen et al.
6,584,703 B1 7/2003 Tapio et al.
6,613,195 B2 9/2003 Anderson
6,863,919 B1 3/2005 Tapio et al.
7,582,187 B2 * 9/2009 Scherb ..... D21F 11/14 162/900
7,943,012 B2 5/2011 Backman et al.
8,236,140 B2 8/2012 Scherb et al.
8,398,819 B2 3/2013 Yeh et al.
8,568,562 B2 10/2013 Sullivan et al.
8,691,323 B2 4/2014 Von Drasek et al.
(Continued)

FOREIGN PATENT DOCUMENTS

EP 2576900 B1 11/2015
WO 2020263157 A1 12/2020

OTHER PUBLICATIONS

International Search Report and Written Opinion for PCT/US2022/051667, mailed Apr. 24, 2023, 9 pages.

*Primary Examiner* — Dennis R Cordray
(74) *Attorney, Agent, or Firm* — Eric D. Babych; Barnes & Thornburg LLP

(57) ABSTRACT

A method applying a composition to a dryer cylinder is provided. The method includes determining an amount of water to apply onto a surface of a dryer cylinder based on a total evaporation rate of the dryer cylinder and spraying a composition including the water and a coating chemistry onto the surface of the dryer cylinder. Systems for applying composition to dryer cylinders are also provided herein.

14 Claims, 1 Drawing Sheet

(56) References Cited

U.S. PATENT DOCUMENTS

| | | | | |
|---|---|---|---|---|
| 10,914,037 | B2 | 2/2021 | Gorden | |
| 10,941,522 | B1 | 3/2021 | Buist et al. | |
| 2003/0049161 | A1 | 3/2003 | Blaschke | |
| 2003/0051369 | A1 | 3/2003 | Aust | |
| 2005/0139807 | A1 | 6/2005 | Tong | |
| 2022/0333307 | A1* | 10/2022 | Bjerke | B31F 1/36 |

* cited by examiner

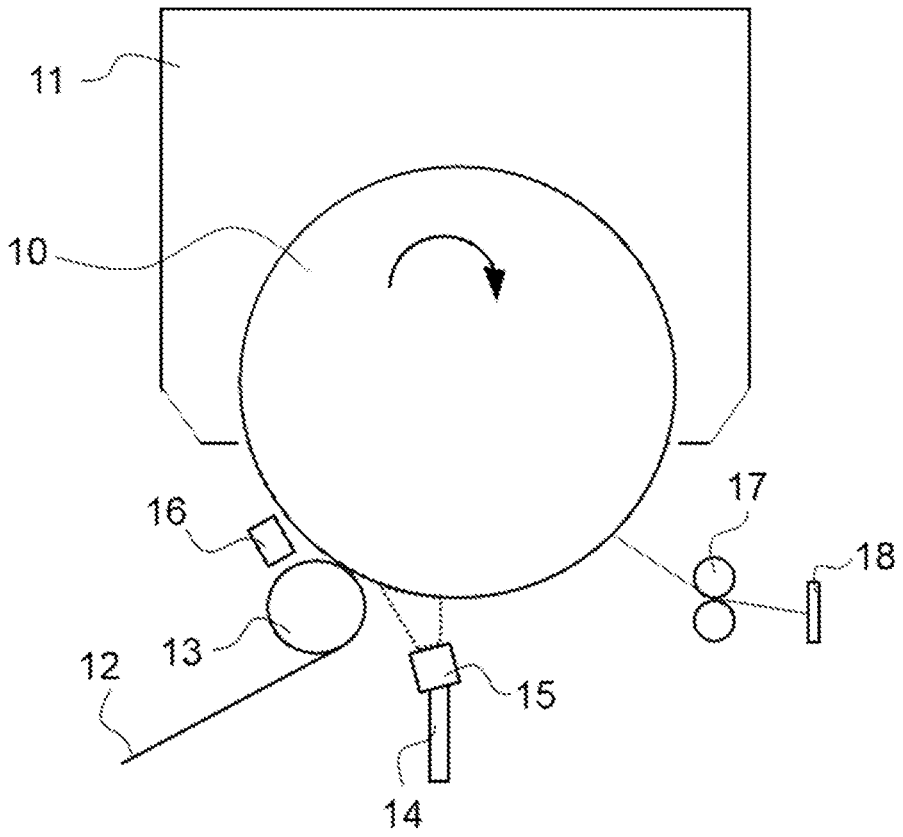
11
10
16
17
18
13
12
15
14

METHOD FOR APPLYING COATING CHEMICALS TO YANKEE DRYERS FOR TISSUE AND TOWEL PRODUCTION

TECHNICAL FIELD

The present disclosure generally relates pulp and paper manufacture. More particularly, the disclosure relates to a method of improving performance of coating chemistries applied to a creping cylinder.

BACKGROUND

In the manufacture of paper tissues, the wet web of fibers, i.e., the wet paper sheet, may be formed, for example, on a fourdrinier, crescent former, twin wire, or a felt, then transferred to a steam heated metal cylinder and dried thereon. The steam heated metal cylinder is typically known as the creping cylinder or "Yankee Dryer." As the wet web of fibers rotates on the cylinder, much of the water is driven off leaving a web of fibers with from about 70 to about 99 weight percent solids. A metal or ceramic blade, known as a creping blade, is then used to remove the web of fibers. As the web is removed, the metal blade compacts the sheet in the machine direction, producing a folding action. This removal and compacting process is known as "creping". Creping causes the paper sheet to wrinkle or pucker. Creping often destroys a large number of fiber to fiber bonds in the paper sheet thereby imparting qualities of bulk, stretch, absorbency and softness characteristics to the tissue paper being manufactured.

In tissue making, it is normal practice to spray a dilute adhesive solution through a spray boom onto the heated metal surface of a creping cylinder to aid in adhesion of a web of fibers to the creping cylinder for drying and subsequent creping. This adhesive material provides adequate adhesion of the web of fibers to the creping cylinder which enhances the manufacture of quality tissue, helps protect the dryer from excessive wear, provides lubrication for the doctor blades, and is soft enough to allow doctor blade tip penetration for good creping. After encountering the layer of adhesive on the creping cylinder, typically the web of fibers is adhered to the cylinder using a pressure roll or suction pressure roll that is positioned such that the web of fibers encounters the pressure roll nip (the pressure roll nip being the point of contact between the pressure roll and the creping cylinder) at approximately the same time that the web of fibers encounters the layer of adhesive. The sheet then continues around the heated cylinder to be creped off with a metallic blade. In the creping process, valued attributes such as softness, absorbency, and bulk are built into the sheet. After the web of fibers has been removed from the creping cylinder by the creping blade, state of the art techniques currently call for spraying the surface of the creping cylinder again with the dilute adhesive solution and the creping process is continued.

When the adhesive solution is applied onto the creping cylinder it is retained on the cylinder and aids in adhesion of a web of fibers to the creping cylinder. One of the problems associated with application of the adhesive solution is transfer of the adhesive chemistry to the web of fibers when the sheet is transferred to the creping cylinder. Improved methods are needed to ensure proper adhesion of the sheet to the creping cylinder without transfer of the adhesive chemistry to the felt.

BRIEF SUMMARY

A method of applying a composition to a dryer cylinder is provided. The method includes determining an amount of water to apply onto a surface of a dryer cylinder based on a total evaporation rate of the dryer cylinder; and spraying a composition comprising the water and a coating chemistry onto the surface of the dryer cylinder.

In some aspects, the method includes adjusting the amount of the water applied to the surface of the dryer cylinder by adjusting a water pressure.

In some aspects, the method includes adjusting the amount of the water applied to the surface of the dryer cylinder by adjusting a distance between the surface of the dryer cylinder and a spraying device.

In some aspects, the method includes determining an evaporative load of the dryer cylinder.

In some aspects, the evaporative load of the dryer cylinder is calculated according to formula I:

$$EL=SFCS/SA \qquad \text{formula I}$$

wherein EL is the evaporative load of the dryer cylinder given in liters per second per meter squared ($L/s/m^2$); SFCS is sprayed flow through the coating shower given in liters per second (L/s); and SA is sprayed area given in meters squared ($m^2$).

In some aspects, the total evaporation rate is calculated according to formula II:

$$Rw=B*W*S*([L/E]-1) \qquad \text{formula II}$$

wherein Rw is the total evaporation rate given in grams of evaporated water per second (g/s); B is (tissue) basis weight at the reel given in grams per meter squared ($g/m^2$); W is paper width given in meters (m); S is reel speed given in meters per second (m/s); L is dryness of a sheet at a hood outlet given in percent (%); and E is dryness of the sheet at a hood inlet given in percent (%), wherein the percentages refer to the dry weight of fiber over the total weight (dry wt. of fiber/dry wt. of fiber+water).

In some aspects, the amount of water applied onto the surface of the dryer cylinder is determined by calculating the amount of water that decreases the difference between an evaporative load of the dryer cylinder and the total evaporation rate.

In some aspects, the spraying device is a spray boom.

In some aspects, the dryer cylinder is a creping cylinder.

In some aspects, the amount of water applied onto the surface of the dryer cylinder is about 3 liters per minute to about 20 liters per minute.

In some aspects, the composition is sprayed onto the surface of the dryer cylinder using a spraying device operating at a pressure of about 40 psi to about 120 psi.

In some aspects, a difference between evaporative load and the total evaporation rate is about 0 to about 150 $kg/h/m^2$.

In some aspects, the method includes measuring dryness of a paper sheet at an outlet of the dryer cylinder.

In some aspects, the coating chemistry comprises a creping adhesive.

A system for applying a composition to a dryer cylinder is also provided. The system includes a dryer cylinder; a spraying device configured to spray a composition comprising water and a coating chemistry onto a surface of the dryer cylinder; at least one nozzle attached to the spraying device; a moisture sensor configured to detect moisture content of a paper sheet at an outlet of the dryer cylinder; and a controller in communication with the spraying device and the moisture sensor. The controller is configured to adjust a distance between the dryer cylinder and the spraying device or an operating pressure of the at least one nozzle to maintain a difference between evaporative load and total evaporation rate that is about 0 to about 40 kg/h/m$^2$.

In some aspects, the system includes a water pressure sensor configured to measure a water pressure of the water before exiting the spraying device.

In some aspects, the controller calculates an evaporative load of the dryer cylinder according to formula I:

$$EL=SFCS/SA \quad \text{formula I}$$

EL is equal to SFCS divided by SA. EL can also be given in kg/s/m$^2$ by multiplying the value of EL in L/s/m$^2$ by the density of water.

In some aspects, the controller calculates total evaporation rate according to formula II:

$$Rw=B*W*S*([L/E]-1) \quad \text{formula II}$$

Total evaporation rate (Rw) can be calculated by multiplying the basis weight at the reel (B) by the paper width (W), the reel speed (S), and the difference between a ratio of the sheet dryness at the outlet (L) divided by sheet dryness at the inlet (E) and 1.

The total evaporation rate can be expressed in kg/h/m$^2$ by multiplying the value of Rw in g/s by 1 kg/1000 g to convert grams to kilograms and multiplying by 3600 seconds/1 hour to convert seconds to hours and then dividing by the drying surface area given in m$^2$.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which:

FIG. 1 shows a schematic of a creping cylinder in relation to a spraying device.

DETAILED DESCRIPTION

Various embodiments are described below with reference to the drawing. The relationship and functioning of the various elements of the embodiments may better be understood by reference to the following detailed description. However, embodiments are not limited to those illustrated in the drawing or explicitly described below. It should be understood that the drawing is not necessarily to scale, and in certain instances details may have been omitted that are not necessary for an understanding of embodiments disclosed herein, such as conventional fabrication and assembly.

A method of applying a composition to a dryer cylinder is provided. This method enables improved performance of coatings applied to a dryer cylinder and eliminates unwanted transfer of the coating to the felt section or transfer section. The methods provided herein resulted in the unexpected finding that the coating performance can be improved by adjusting the amount of water applied with the coating chemistry thereby affecting the evaporative load of the dryer cylinder.

The method includes determining an amount of water to apply onto a surface of a dryer cylinder based on a total evaporation rate of the dryer cylinder; and spraying a composition comprising the water and a coating chemistry onto the surface of the dryer cylinder.

In some aspects, the dryer cylinder is a creping cylinder.

"Creping" refers to the intentional wrinkling of paper during drying to produce a soft, elastic sheet of tissue paper. A creping blade, also known as a Doctor blade, is used to intentionally wrinkle the paper.

A "Yankee Dryer" is another term, mostly used in North America, for a creping cylinder that is used to crepe tissue.

FIG. 1 shows a Yankee dryer (10) adjacent to a hood (11). A tissue web (12) is fed to and pressed onto the Yankee dryer (10) using a press roll (13). A spraying device (14) comprising at least one nozzle (15) sprays a composition onto the surface of the Yankee dryer (10). Sensors (16,18) are placed at certain positions to monitor the tissue web (12) or Yankee dryer (10) surface. Calendar rolls (17) guide the dried tissue web exiting the hood (11) and Yankee dryer (10).

In some aspects, sensor (16) can measure the dryness of the sheet. The sensor (16) can be configured to detect moisture content of the sheet and relay the information to a controller.

In some aspects, manual measurement of the dryness of the sheet can be conducted at the position of the sensor (16). In order to determine the % of the dryness of the sheet, a sample of paper may be collected, for example, from the surface of the Yankee dryer (10) just after the sheet transfer onto this dryer (10).

In some aspects, the sensor (18) is a scanner used to determine the basis weight and the moisture content of the sheet (cross direction and/or machine direction).

The total evaporation rate is calculated according to formula II:

$$Rw=B*W*S*([L/E]-1) \quad \text{formula II.}$$

The basis weight and moisture content can be measured using conventional techniques available to one of ordinary skill in the art. For example, high-performance infrared instruments could be used to measure basis weight and moisture content of the sheet.

Mechanical and thermal processes are typically used to dewater a paper sheet. For example, on a crescent former, the incoming solids content before transfer is about 10 wt. %. After pressing and transfer, the solids content is about 40 to about 45 wt. %. The sheet may then be passed to a Yankee dryer and hood where dryness is increased between about 93 and 97 wt. %. The hood encases at least a portion of the Yankee dryer.

Generally, hoods include a dry end and a wet end. In most cases, the hoods are impinging hot air onto the sheet surface to assist with drying but alternatively or additionally, the hoods may apply vacuum or suction.

In some aspects, the amount of water added with the coating chemistry through the spray boom can be adjusted. Examples of adjusting the amount of water include adjusting the water pressure and/or adjusting a distance between the surface of the dryer cylinder and the spraying device. The coating chemistry may be fed into a carrier fluid, such as water, to form a mixture and the mixture may be passed through the spraying device. By reducing the water pressure, the volume of water passing through the spraying device may be reduced. The water pressure can be increased or decreased by adjusting the header pressure of the spray device.

The amount of water added to the surface of the dryer cylinder with the coating chemistry affects the evaporative load on the dryer cylinder. The evaporative load of the dryer cylinder is calculated according to formula I:

$$EL=SFCS/SA \quad \text{formula I.}$$

In some aspects, the amount of water applied onto the surface of the dryer cylinder is determined by calculating the amount of water that decreases the difference between an evaporative load of the dryer cylinder and the total evaporation rate.

In some aspects, the spraying device is a spray boom. A spray boom can include at least one nozzle. In some aspects, the spray boom includes a plurality of nozzles. The nozzles are oriented on the spray boom to provide uniform coverage of the dryer cylinder. Spray patterns can include double or triple coverage to provide a more constant spray delivery rate over the dyer cylinder face and more uniform coverage.

In some aspects, the amount of water applied onto the surface of the dryer cylinder is about 3 liters per minute to about 20 liters per minute. In some aspects, the amount of water applied onto the surface of the dryer cylinder is about 3 liters per minute to about 10 liters per minute. In some aspects, the amount of water applied onto the surface of the dryer cylinder is about 3 liters per minute to about 8 liters per minute, about 3 liters per minute to about 5 liters per minute, about 5 liters per minute to about 20 liters per minute, about 5 liters per minute to about 18 liters per minute, about 5 liters per minute to about 15 liters per minute, about 5 liters per minute to about 12 liters per minute, about 3 liters per minute to about 18 liters per minute, or about 3 liters per minute to about 15 liters per minute.

In some aspects, the composition is sprayed onto the surface of the dryer cylinder using a spraying device operating at a pressure of about 40 psi to about 120 psi. In some aspects, the composition is sprayed onto the surface of the dryer cylinder using a spraying device operating at a pressure of about 60 psi to about 100 psi. In some aspects, the composition is sprayed onto the surface of the dryer cylinder using a spraying device operating at a pressure of about 60 psi to about 120 psi, about 60 psi to about 90 psi, about 60 psi to about 85 psi, about 60 psi to about 80 psi, about 40 psi to about 110 psi, about 40 psi to about 100 psi, about 40 psi to about 90 psi, about 40 psi to about 80 psi, or about 40 psi to about 70 psi.

In some aspects, a difference between evaporative load and the total evaporation rate is about 0 to about 150 $kg/h/m^2$. In some aspects, a difference between evaporative load and the total evaporation rate is about 0 to about 40 $kg/h/m^2$. In some aspects, a difference between evaporative load and the total evaporation rate is about 1 to about 100 $kg/h/m^2$, about 1 to about 80 $kg/h/m^2$, or about 1 to about 40 $kg/h/m^2$, about 0 to about 30 $kg/h/m^2$, about 0 to about 20 $kg/h/m^2$, about 0 to about 10 $kg/h/m^2$, or about 0 to about 5 $kg/h/m^2$.

In some aspects, the method includes measuring dryness of a paper sheet at an outlet of the dryer cylinder.

The coating chemistry can include a creping adhesive. Creping adhesives for preparing creped paper include, but are not limited to, hydrolyzed N-vinylformamide polymers, polyamines, polyamides, polyamidoamines, amidoamine-epichlorohydrin polymers, polyethyleneimines, polyvinyl alcohol, vinyl alcohol copolymers, polyvinyl acetate, vinyl acetate copolymers, polyethers, polyacrylic acid, acrylic acid copolymers, cellulose derivatives, starches, starch derivatives, animal glue, and crosslinked vinylamine/vinyl-alcohol polymers as described in U.S. Pat. No. 5,374,334 (the contents of which are incorporated herein by reference), glyoxalated acrylamide/diallyldimethyl acrylamide copolymers; the polymers disclosed in U.S. Pat. Nos. 5,179,150 and 5,167,219 (the contents of which are incorporated herein by reference); an admixture of from about 0.1 to about 50 weight percent of a first polyamide-epihalohydrin resin and from about 99.9 to about 50 weight percent of a second polyamide-epihalohydrin resin, as described in U.S. Pat. No. 6,277,242 (the contents of which are incorporated herein by reference) and halogen-free creping cylinder adhesives based on cross-linked cationic polyaminoamide polymers as described in U.S. Pat. No. 5,382,323 (the contents of which are incorporated herein by reference).

The coating chemistry may include other additives, such as humectants, plasticizers, or surfactants, for example.

A "humectant" is a substance having affinity for water with stabilizing action on the water content of a material. A humectant keeps the moisture content caused by humidity fluctuations within a narrow range. When used in a creping process a humectant is used to keep the moisture content of the adhesive chemistry at the desired level such that the adhesive chemistry can promote optimal adhesion of the web to the creping cylinder.

Examples of humectants include, but are not limited to, low molecular weight water soluble polyols, such as polyglycerol, polyethylene glycol, propylene glycol, ethylene glycol, diethylene glycol, triethylene glycol, dipropylene glycol and glycerol. In some embodiments, the humectant is selected from the group consisting of ethylene glycol and propylene glycol and glycerol. In some embodiments, the humectant is glycerol. When present in the composition, the amount of humectant is from about 0.5 wt. % percent to about 70 wt. %. In some aspects, the amount of humectant in the coating chemistry is from about 1 wt. % to about 60 wt. %, about 5 wt. % to about 50 wt. %, about 10 wt. % to about 40 wt. %, or from about 15 wt. % to about 30 wt. %. In some embodiments, the amount of humectant in the coating chemistry is about 5 wt. %, about 10 wt. %, about 15 wt. %, or about 20 wt. %.

A "plasticizer" is an organic compound added to a high molecular weight polymer both to facilitate processing and to increase the flexibility and toughness of the coating chemistry. Examples of plasticizers include, but are not limited to, simple sugars such as glucose, fructose, and sorbitol. When present in the composition, the amount of plasticizer is from about 10 wt. % to about 30 wt. %. In some aspects, the amount of plasticizer in the composition is from about 15 wt. % to about 25 wt. %. In some aspects, the amount of plasticizer in the composition is about 20 wt. %.

A "surfactant" is any compound that reduces surface tension when dissolved in water or water solutions, or any compound that reduces interfacial tension between two liquids. Examples of surfactants include, but are not limited to, ethylene oxide homopolymers, propylene oxide homopolymers, ethylene oxide/propylene oxide copolymers (hereinafter "EO/PO" copolymers), fatty acid esters of ethylene oxide homopolymers, fatty acid esters of propylene oxide homopolymers, fatty acid esters of EO/PO copolymers, quaternary ammonium compounds, such as dialkyl dimethyl quaternaries, diamido amine quaternaries, dialkyl alkoxylated quaternaries, imidazoline quaternaries and imidazoline methyl sulfate. In some aspects, the surfactant is imidazoline methyl sulfate.

When present in the composition, the amount of surfactant is from about 5 wt. % to about 20 wt. %. In some aspects, the amount of surfactant is from about 10 wt. % to about 15 wt. %. In some aspects, the amount of surfactant is about 12 wt. %.

A system for applying a composition to a dryer cylinder is also provided. The system includes a dryer cylinder; a spraying device configured to spray a composition comprising water and a coating chemistry onto a surface of the dryer cylinder; at least one nozzle attached to the spraying device; a moisture sensor configured to detect moisture content of a paper sheet at an outlet of the dryer cylinder; and a controller in communication with the spraying device and the moisture sensor. The controller is configured to adjust a distance between the dryer cylinder and the spraying device or an operating pressure of the at least one nozzle to maintain a difference between evaporative load and total evaporation rate that is about 0 to about 40 kg/h/m$^2$.

In some aspects, the system includes a water pressure sensor configured to measure a water pressure of the water before exiting the spraying device.

In some aspects, the controller calculates an evaporative load of the dryer cylinder according to formula I:

$$EL=SFCS/SA \qquad \text{formula I.}$$

In some aspects, the controller calculates total evaporation rate according to formula II:

$$Rw=B*W*S*([L/E]-1) \qquad \text{formula II.}$$

As used herein, the term "controller" refers to a manual operator or an electronic device having components, such as a processor, memory device, digital storage medium, a communication interface including communication circuitry operable to support communications across any number of communication protocols and/or networks, a user interface (e.g., a graphical user interface that may include cathode ray tube, liquid crystal display, plasma display, touch screen, or other monitor), and/or other components.

The controller is preferably operable for integration with one or more application-specific integrated circuits, programs, computer-executable instructions or algorithms, one or more hard-wired devices, wireless devices, and/or one or more mechanical devices. Moreover, the controller is operable to integrate the feedback, feed-forward, and/or predictive loop(s) of the invention. Some or all of the controller system functions may be at a central location, such as a network server, for communication over a local area network, wide area network, wireless network, internet connection, microwave link, infrared link, wired network (e.g., Ethernet) and the like. In addition, other components, such as a signal conditioner or system monitor, may be included to facilitate signal transmission and signal-processing algorithms.

In certain aspects, the controller includes hierarchy logic to prioritize any measured or predicted properties associated with system parameters. For example, the controller may be programmed to prioritize system paper dryness. It should be appreciated that the object of such hierarchy logic is to allow improved control over the system parameters and to avoid circular control loops.

In some embodiments, the monitoring and controlling unit and method associated therewith includes an automated controller. In some embodiments, the controller is manual or semi-manual. For example, when the system includes one or more datasets received from various sensors in the system, the controller may either automatically determine which data points/datasets to further process or an operator may partially or fully make such a determination. System parameters are typically measured with any type of suitable data capturing equipment, such as sensors designed specifically for these parameters, e.g., moisture content, temperature sensors, thermocouples, pressure sensors, corrosion probes, and/or any other suitable device or sensor. Data capturing equipment is in communication with the controller and, according to some embodiments, may have advanced functions (including any part of the control algorithms described herein) imparted by the controller.

The monitoring and controlling unit may comprise a plurality of sensors, which are capable of analyzing the paper sheet and dryer cylinder. The monitoring and controlling unit may comprise any of these sensors, all of these sensors, a combination of two or more of these sensors, one or more additional sensors not specifically mentioned here, and the sensors may be in communication with the controller.

The presently disclosed monitoring and controlling system comprises, in certain embodiments, one or more chemical injection pumps in fluid communication with the spraying device. Each chemical injection pump may be in fluid communication with a storage device. Each storage device may comprise one or more chemicals and the chemical injection pumps may transport those chemicals into the spraying device. The chemical injection pumps may be in communication with the controller in any number of ways, such as through any combination of wired connection, a wireless connection, electronically, cellularly, through infrared, satellite, or according to any other types of communication networks, topologies, protocols, standards and more. Accordingly, the controller can send signals to the pumps to control their chemical feed rates.

In certain embodiments, the monitoring and controlling system is implemented to have the plurality of sensors provide continuous or intermittent feedback, feed-forward, and/or predictive information to the controller, which can relay this information to a relay device, such as the Nalco Global Gateway, which can transmit the information via cellular communications to a remote device, such as a cellular telephone, computer, and/or any other device that can receive cellular communications. This remote device can interpret the information and automatically send a signal (e.g. electronic instructions) back, through the relay device, to the controller to cause the controller to make certain adjustments to the output of the pumps. The information can also be processed internally by the controller and the controller can automatically send signals to the pumps to adjust the amount of chemical injection, for example. Based upon the information received by the controller from the plurality of sensors or from the remote device, the controller may transmit signals to the various pumps to make automatic, real-time adjustments, to the amount of chemical that the pumps are injecting.

EXAMPLES

Example 1

This test was made on a Crescent former dry crepe machine when they produced a 11.5 pounds per 3000 ft$^2$ 100% virgin bath tissue. This machine is using a 15 feet diameter, 3.64 m width metallized Yankee dryer with an operational Yankee speed of 1530 m/min at the time of the evaluation.

The total volume flow rate of the carrying water (which included the coating chemistry) was reduced from about 11.2 lpm to about 6.7 lpm. Based on the Rw calculation, this change in water volume reduced the evaporative load from 157 kg/h/m$^2$ to 94 kg/h/m$^2$. Also, based on the calculation, the Rw (Total evaporation rate) for this specific machine was 118 kg/h/m$^2$. Without being constrained by any particular theory, it is believed that by closing the gap between the water load and the evaporative rate, the coating chemistry was able to stay on the dryer and the coating transfer to the felt section was reduced.

The impact of the change in evaporation load on the performance of the coating chemistry used on the Yankee dryer was significant. This balance between load and evaporation capacity has improved the following aspects: reduced transfer of adhesive to felt, decreased vacuum from the press box, decreased need for high pressure in the cleaning shower, and improved bulk/basis weight ratio, creping efficiency, and softness.

TABLE 1

| | Shower Nozzle 11001* - 45 psi (operating pressure of nozzles/ spray boom) | Shower Nozzle 95005** - 80 psi |
|---|---|---|
| Basis weight (g/m2) | 17.908 | 17.908 |
| Yankee speed (m/s) | 25.5 | 25.5 |
| Reel speed (m/s) | 21.7 | 21.7 |
| Yankee width (m) | 3.64 | 3.64 |
| Paper width (m) | 3.24 | 3.24 |
| Yankee diameter (m) | 4.57 | 4.57 |
| Spray flow (L/s) | 0.186 | 0.111 |
| Spray flow (L/min) | 11.18 | 6.64 |
| Spray load (shower to nip) (mL) | 8.549 | 5.078 |
| Spray load (shower to nip) (mL/m2) | 2.007 | 1.192 |
| Dwell distance (m) | 1.17 | 1.17 |
| Dwell distance (inches) | 46 | 46 |
| Dwell time (sec) | 0.046 | 0.046 |
| Dwell time (msec) | 45.88 | 45.88 |
| Sprayed area (m$^2$) | 4.26 | 4.26 |
| Drying surface area (m$^2$) | 52.26 | 52.26 |
| Rw (Rw Hoods + Rw Yankee) (kg/h/m2) | 117.84 | 117.84 |
| Production tons/m2 of Yankee surface | 25.83 | 25.83 |
| Evaporative load (kg/h/m$^2$) | 157 | 94 |
| Production rate (tpd) | 110 | 110 |
| Production rate (kg dry/hr) | 4354.17 | 4354.17 |
| Creping moisture (%) | 5 | 5 |
| Dryness Yankee outlet (%) | 95 | 95 |
| Dryness hood inlet (%) | 43 | 43 |
| Post nip moisture (%) | 57 | 57 |
| Water evaporated (kg/hr) | 6158.08 | 6158.08 |
| Time to evaporate (rate VS load) (msec) | 61.33 | 36.43 |
| Distance to evaporate the load (in) | 61.09 | 36.28 |
| Dryness of coating layer @ transfer (%) | 75 | 126 |
| Spray velocity (m/s) | 19.39 | 24.14 |
| Spray nozzle size (in) | 0.026 | 0.018 |

* Shower nozzle 11001 has a spray angle of 110 degrees and a flow rate of 0.1 gpm at 40 psi of water pressure.
** Shower nozzle 95005 has a spray angle of 95 degrees and a flow rate of 0.5 gpm at 40 psi of water pressure.

Evaporative rate Rw (kg/h/m$^2$)=Rw (g/s)*(1 Kg/1000 g)*(3600 seconds/1 hour)/Drying surface area (m$^2$)

Drying surface area (m$^2$)=2*PI*$r$*Yankee width (m), wherein "$r$"=the radius of the Yankee dryer.

Evaporative load (L/s/m$^2$) convert to (kg/h/m$^2$)=Sprayed flow coating shower (L/s)/ Sprayed area (m$^2$)

Sprayed area (m$^2$)=Yankee width (m)*Distance between shower and nip of the press (m)

% of Dryness of the coating layer at the press nip (Theorical)=(Evaporative rate/Evaporative load)*100

Without being bound by any particular theory, by reducing the water load, the coating layer seemed to be more durable to support the rewet into the nip of the press. This increase in durability of the coating layer, was perceptible with less coating transfer into the felt section. Less coating into the felt section, also meant more coating retention onto the surface of the Yankee dryer, and a better Yankee protection as well as a better coating performances in the development of the physical properties.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a sensor" is intended to include "at least one sensor" or "one or more sensors."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Any composition disclosed herein may comprise, consist of, or consist essentially of any element, component and/or ingredient disclosed herein or any combination of two or more of the elements, components or ingredients disclosed herein.

Any method disclosed herein may comprise, consist of, or consist essentially of any method step disclosed herein or any combination of two or more of the method steps disclosed herein.

The transitional phrase "comprising," which is synonymous with "including," "containing," or "characterized by," is inclusive or open-ended and does not exclude additional, un-recited elements, components, ingredients and/or method steps.

The transitional phrase "consisting of" excludes any element, component, ingredient, and/or method step not specified in the claim.

The transitional phrase "consisting essentially of" limits the scope of a claim to the specified elements, components, ingredients and/or steps, as well as those that do not materially affect the basic and novel characteristic(s) of the claimed invention.

Unless specified otherwise, all molecular weights referred to herein are weight average molecular weights and all viscosities were measured at 25° C. with neat (not diluted) polymers.

As used herein, the term "about" refers to the cited value being within the errors arising from the standard deviation found in their respective testing measurements, and if those errors cannot be determined, then "about" may refer to, for example, within 5% of the cited value.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of applying a composition to a dryer cylinder, comprising:

determining an amount of water to apply onto a surface of a dryer cylinder based on a total evaporation rate of the dryer cylinder; and spraying a composition comprising the water and a coating chemistry onto at least a portion of the surface of the dryer cylinder.

2. The method of claim 1, further comprising adjusting the amount of the water sprayed to the surface of the dryer cylinder by adjusting a water pressure.

3. The method of claim 1, further comprising adjusting the amount of the water sprayed to the surface of the dryer cylinder by adjusting a distance between the surface of the dryer cylinder and a spraying device.

4. The method of claim 1, further comprising determining an evaporative load of the dryer cylinder.

5. The method of claim 4, further comprising spraying the composition with a coating shower, wherein the evaporative load of the dryer cylinder is calculated according to formula I:

$$EL=SFCS/SA \qquad \text{formula I}$$

wherein EL is the evaporative load of the dryer cylinder given in liters per second per meter squared ($L/s/m^2$); SFCS is sprayed flow through the coating shower given in liters per second (L/s); and SA is a total surface area sprayed given in meters squared ($m^2$).

6. The method of claim 1, wherein the total evaporation rate is calculated according to formula II:

$$Rw=B*W*S*([L/E]-1) \qquad \text{formula II}$$

wherein Rw is the total evaporation rate given in grams of evaporated water per second (g/s); B is basis weight at a reel given in grams per meter squared ($g/m^2$); W is paper width given in meters (m); S is reel speed given in meters per second (m/s); L is dryness of a sheet at a hood outlet given in percent (%); and E is dryness of the sheet at a hood inlet given in percent (%).

7. The method of claim 3, wherein the spraying device is a spray boom.

8. The method of claim 1, wherein the dryer cylinder is a creping cylinder.

9. The method of claim 1, wherein the amount of the water applied onto the surface of the dryer cylinder by spraying the composition is about 3 liters per minute to about 20 liters per minute.

10. The method of claim 1, wherein the composition is sprayed onto the surface of the dryer cylinder using a spraying device operating at a pressure of about 40 psi to about 120 psi.

11. The method of claim 1, wherein a difference between evaporative load and the total evaporation rate is about 0 to about 150 $kg/h/m^2$.

12. The method of claim 1, further comprising measuring dryness of a paper sheet at an outlet of the dryer cylinder.

13. The method of claim 1, wherein the coating chemistry comprises a creping adhesive.

14. The method of claim 1, further comprising spraying the composition comprising the water and the coating chemistry onto the entire surface of the dryer cylinder.

* * * * *